US011162210B2

(12) United States Patent
Hussain

(10) Patent No.: US 11,162,210 B2
(45) Date of Patent: Nov. 2, 2021

(54) DRAIN PUMP FOR WASHING MACHINE APPLIANCE

(71) Applicant: Haier US Appliance Solutions, Inc., Wilmington, DE (US)

(72) Inventor: Syed Hussain, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 222 days.

(21) Appl. No.: 16/243,126

(22) Filed: Jan. 9, 2019

(65) Prior Publication Data

US 2020/0217003 A1 Jul. 9, 2020

(51) Int. Cl.

| | |
|---|---|
| ***D06F 39/08*** | (2006.01) |
| ***D06F 23/04*** | (2006.01) |
| ***F04D 29/12*** | (2006.01) |
| ***F04D 13/06*** | (2006.01) |
| *D06F 35/00* | (2006.01) |

(52) U.S. Cl.

CPC ..... *D06F 39/085* (2013.01); *D06F 23/04* (2013.01); *F04D 13/06* (2013.01); *F04D 29/126* (2013.01); *D06F 35/006* (2013.01); *D06F 35/007* (2013.01); *F05D 2260/602* (2013.01)

(58) Field of Classification Search

CPC ..... D06F 23/04; D06F 35/006; D06F 35/007; D06F 39/085; D06F 2204/084; F04D 13/06; F04D 29/126; F05D 2260/602

See application file for complete search history.

(56) References Cited

U.S. PATENT DOCUMENTS

| | | | | |
|---|---|---|---|---|
| 3,018,650 | A * | 1/1962 | Schmidt | D06F 39/085 68/23.4 |
| 3,323,529 | A * | 6/1967 | Geiger | A47L 15/4227 134/104.1 |
| 3,502,090 | A * | 3/1970 | Grunewald | A47L 15/4206 134/111 |
| 4,392,891 | A * | 7/1983 | Meyers | A47L 15/4202 134/10 |
| 4,998,861 | A | 3/1991 | Fukuzawa et al. | |

(Continued)

FOREIGN PATENT DOCUMENTS

| | | | |
|---|---|---|---|
| CN | 1210705 | A | 3/1999 |
| CN | 203926120 | U | 11/2014 |

(Continued)

*Primary Examiner* — Joseph L. Perrin
(74) *Attorney, Agent, or Firm* — Dority & Manning, P.A.

(57) ABSTRACT

A washing machine appliance and pumps therefore are provided. In one example aspect, a drain pump for a washing machine appliance includes features for improving pump performance and sand and debris management. The drain pump includes a pump housing and a pump body defining a pump chamber in which an impeller having a disk and blades is rotatably mounted. The pump body has a base defining a pump body recess. An outer rim of the base defines an outer periphery of the pump body recess. The disk is spaced from the outer rim so that sand and debris can be flushed from beneath the impeller. A sloped surface of the outer rim also facilitates removal of sand and debris from beneath the impeller. A labyrinth is defined beneath blades of the impeller to prevent sand and debris from entering an area between a seal and a shaft of the impeller.

8 Claims, 8 Drawing Sheets

(56) References Cited

U.S. PATENT DOCUMENTS

| | | | | |
|---|---|---|---|---|
| 9,422,661 | B2 | 8/2016 | Mantle et al. | |
| 2007/0071617 | A1* | 3/2007 | Orue | F04D 29/2261 417/423.1 |
| 2014/0000664 | A1* | 1/2014 | Badafem | D06F 39/08 134/57 R |
| 2018/0073186 | A1* | 3/2018 | Choi | D06F 25/00 |
| 2019/0383303 | A1* | 12/2019 | Cho | H02K 5/124 |

FOREIGN PATENT DOCUMENTS

| | | | |
|---|---|---|---|
| CN | 205225856 | U | 5/2016 |
| JP | 03750265 | B2 | 3/2006 |
| JP | 4957700 | B2 | 6/2012 |

* cited by examiner

DRAIN PUMP FOR WASHING MACHINE APPLIANCE

FIELD OF THE INVENTION

The subject matter of the present disclosure relates generally to washing machine appliances, and more particularly to drain pumps for washing machine appliances.

BACKGROUND OF THE INVENTION

Washing machine appliances generally include a cabinet that receives a wash tub for containing water or wash fluid (e.g., water and detergent, bleach, or other wash additives). A wash basket is rotatably mounted within the wash tub and defines a wash chamber for receipt of articles for washing. Washing machine appliances are typically equipped to operate in one or more modes or cycles, such as wash, rinse, and spin cycles. For example, during a wash or rinse cycle, wash fluid is directed into the wash tub in order to wash and/or rinse articles within the wash chamber. In addition, the wash basket and/or an agitation element can rotate at various speeds to agitate or impart motion to articles within the wash chamber. During a spin cycle, the wash basket may be rotated at high speeds, e.g., to wring wash fluid from articles within the wash chamber.

During or at the end of certain cycles, wash fluid is drained from the wash chamber. A drain pump can facilitate drainage of the wash fluid from the wash chamber. Drain pumps typically include an impeller positioned within a chamber defined by a pump body. The impeller typically has a disk and blades radially extending from a shaft of the impeller. Conventionally, the disk of the impeller has extended radially outward from the shaft such that a small radial gap is defined between the pump body and the disk. In some instances, sand and other relatively large particles can find their way through the radial gap and can become trapped between the disk impeller and the pump body below the impeller. Sand and other large particles can accumulate in the space between the disk and the pump body over time, and as a result, the drain pump can clog. Moreover, in some instances, sand and other larger particles can become lodged in a well defined by the pump body. A shaft of the impeller can be positioned within the well. Sand and other relatively large particles lodged within the well can cause a decrease in performance of the drain pump and can cause the drain pump to clog.

Accordingly, an improved drain pump that addresses one or more of the challenges noted above would be useful.

BRIEF DESCRIPTION OF THE INVENTION

Aspects and advantages of the invention will be set forth in part in the following description, or may be apparent from the description, or may be learned through practice of the invention.

In one example embodiment, a pump for an appliance is provided. The pump defines an axial direction, a radial direction, a circumferential direction, and an axis of rotation extending along the axial direction. The pump includes a pump body at least partially defining a pump chamber, the pump body having a base with a base wall and an outer rim extending from the base wall along the axial direction, wherein the outer rim has a sloped face that slopes outward along the radial direction from the axis of rotation as the sloped face extends away from the base wall along the axial direction. Further, the pump includes an impeller positioned within the pump chamber and rotatable about the axis of rotation.

In some embodiments, the axial direction extends along a vertical direction. Further, in some embodiments, the pump is a vertically mounted pump. Moreover, in some embodiments, the impeller is a bi-directional impeller.

In another example embodiment, a pump for an appliance is provided. The pump defines an axial direction, a radial direction, a circumferential direction, and an axis of rotation extending along the axial direction. The pump includes a pump body at least partially defining a pump chamber and a well and having a base defining a pump body recess. Further, the pump includes an impeller positioned within the pump chamber and rotatable about the axis of rotation, the impeller having a shaft positioned within the well of the base, a plurality of blades extending outward from the shaft along the radial direction and spaced from one another along the circumferential direction, and a disk connecting adjacent blades of the plurality of blades and extending outward from the shaft along the radial direction, wherein the impeller defines a cutout. In addition, the pump includes a seal disposed around the shaft of the impeller and positioned at least partially in the well and at least partially within the cutout defined by the impeller such that the impeller overhangs the seal.

In yet another example embodiment, a washing machine appliance is provided. The washing machine appliance includes a cabinet, a tub positioned within the cabinet, and a basket rotatably mounted within the tub, the basket defining a wash chamber for receipt of articles for washing. The washing machine appliance further includes a drain pump fluidly connected with the tub and operable to drain wash fluid from the tub, the drain pump defining an axial direction, a radial direction, a circumferential direction, and an axis of rotation extending along the axial direction. The drain pump includes a pump body at least partially defining a pump chamber and a well, the pump body having a base with a base wall and an outer rim extending from the base wall along the axial direction, the outer rim having a sloped face that connects the base wall with a top face of the outer rim, and wherein the sloped face slopes outward along the radial direction from the axis of rotation as the sloped face extends away from the base wall along the axial direction. Further, the drain pump includes an impeller positioned within the pump chamber and rotatable about the axis of rotation, the impeller having a shaft positioned within the well, a plurality of blades extending outward from the shaft along the radial direction and spaced from one another along the circumferential direction, and a disk connecting adjacent blades of the plurality of blades and extending outward from the shaft along the radial direction, wherein the impeller defines a cutout and the disk is spaced from the top face of the outer rim along the radial direction. In addition, the drain pump includes a seal disposed around the shaft of the impeller and positioned at least partially in the well and at least partially within the cutout defined by the impeller such that the impeller overhangs the seal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
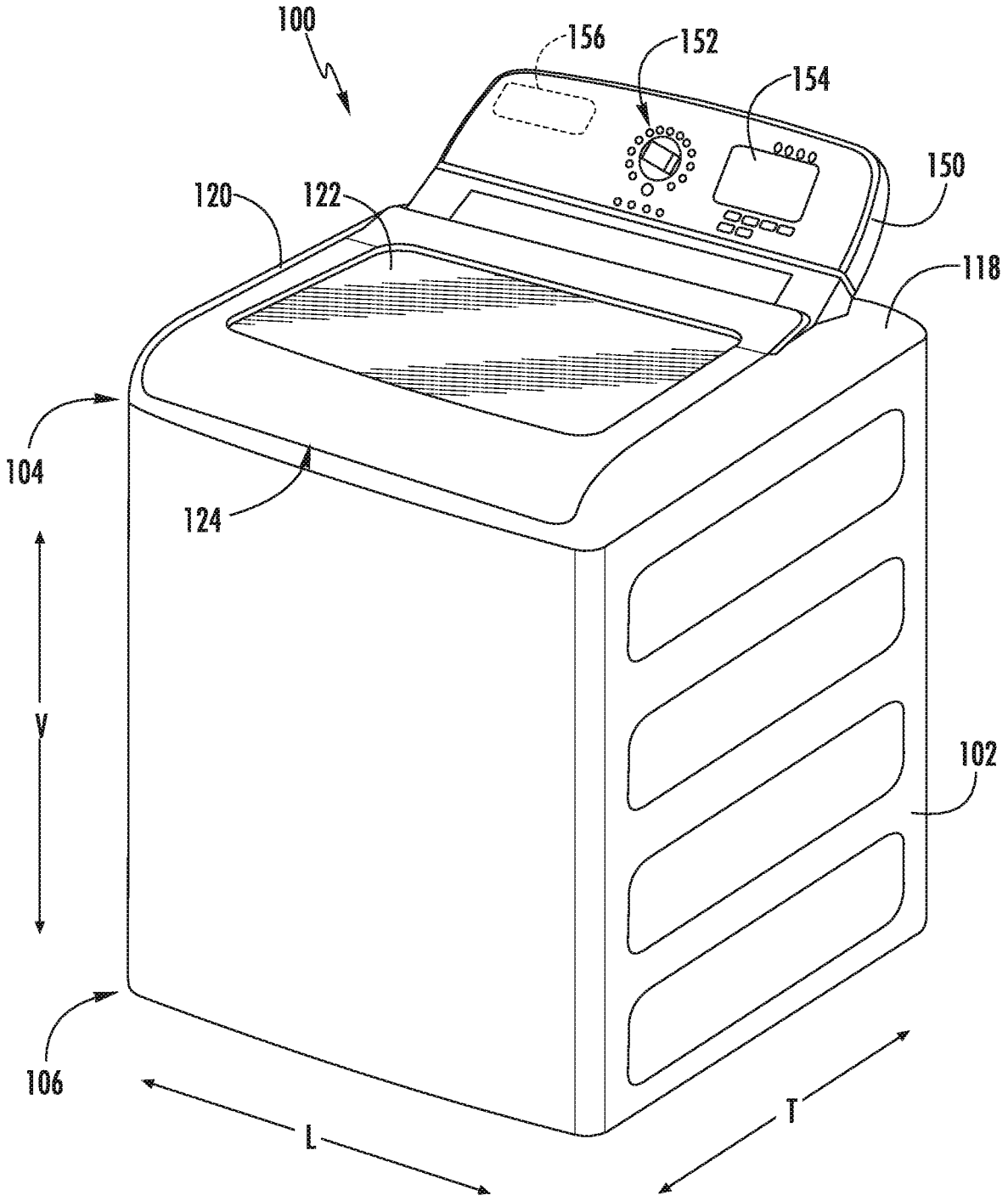
FIG. 1 provides a perspective view of a washing machine appliance according to an example embodiment of the present subject matter with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "approximately," "substantially," or "about," refer to being within a ten percent (10%) margin of error.

Figure 2:
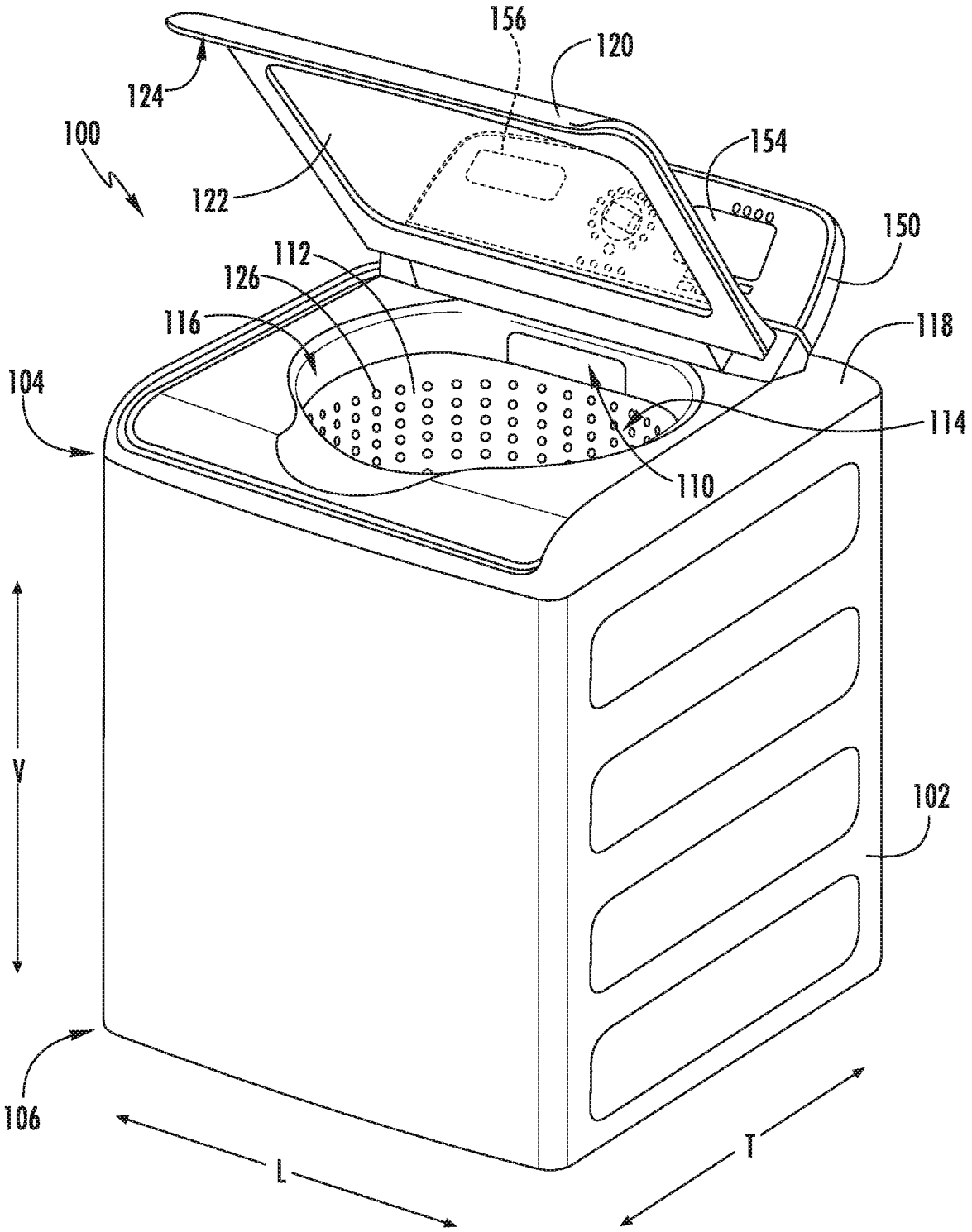
FIG. 2 provides a perspective view of the washing machine appliance of FIG. 1 with the door of the example washing machine appliance shown in an open position.
Figure 3:
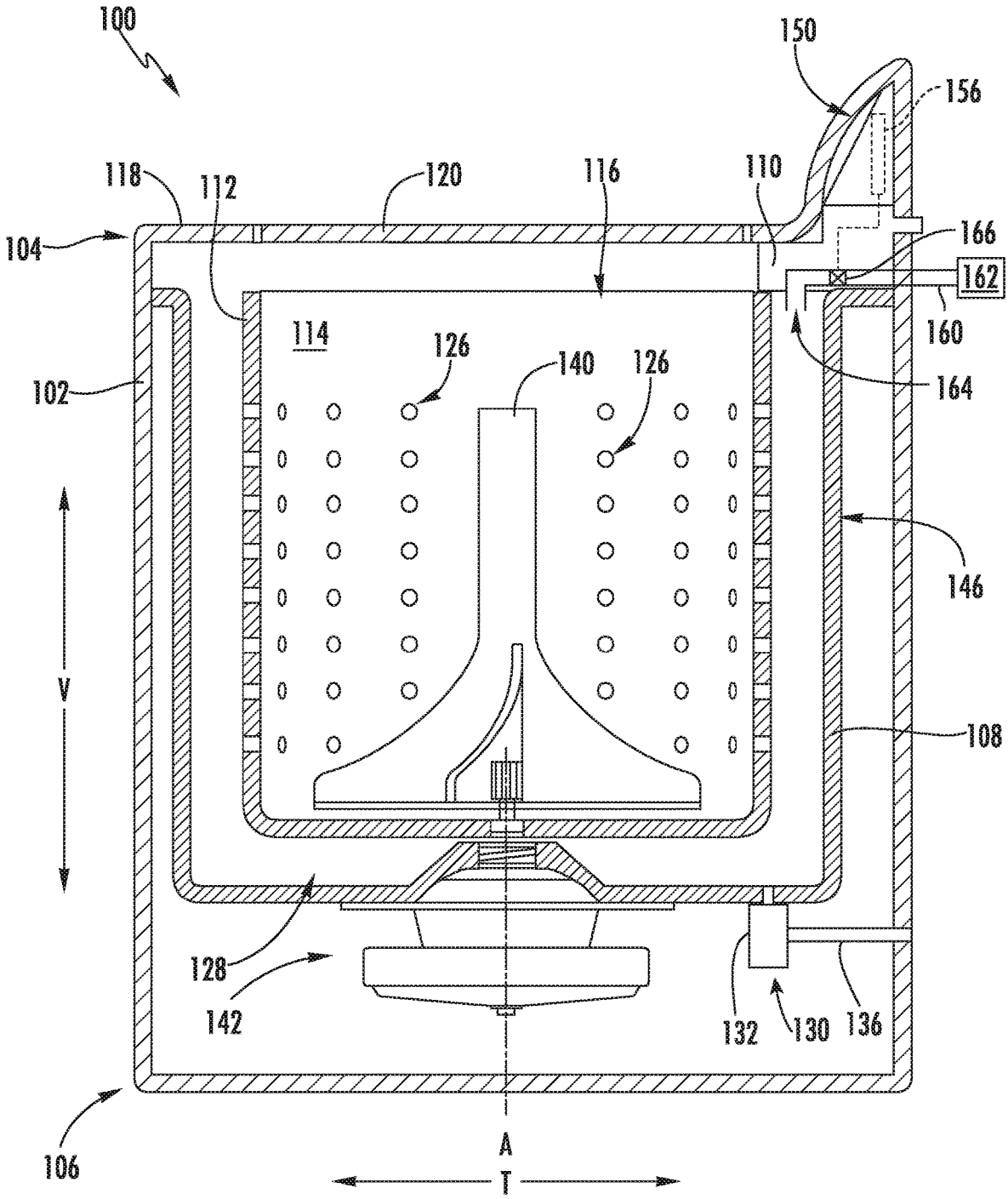
FIG. 3 provides a side, cross sectional view of the washing machine appliance of FIG. 1 according to an example embodiment of the present subject matter.

FIGS. 1, 2, and 3 illustrate an example embodiment of a vertical axis washing machine appliance 100. Specifically, FIGS. 1 and 2 provide perspective views of washing machine appliance 100 in a closed and an open position, respectively. FIG. 3 provides a schematic side cross-sectional view of washing machine appliance 100. While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a front load or horizontal axis washing machine appliance. Indeed, modifications and variations may be made to washing machine appliance 100, including different configurations, different appearances, and/or different features while remaining within the scope of the present subject matter. Further, aspects of the present subject matter may be used for other suitable appliances, such as dishwasher appliances.

As shown, washing machine appliance 100 defines a vertical direction V, a lateral direction L (FIGS. 1 and 2), and a transverse direction T, each of which is mutually perpendicular such that an orthogonal coordinate system is defined. Washing machine appliance 100 has a cabinet 102 that extends between a top portion 104 and a bottom portion 106 along the vertical direction V. As best shown in FIG. 3, a tub 108 is positioned within cabinet 102 and is configured for retaining wash fluids during an operating cycle. Washing machine appliance 100 further includes a primary dispenser 110 (FIGS. 2 and 3) for dispensing wash fluid into tub 108. The term "wash fluid" refers to a liquid used for washing and/or rinsing articles during an operating cycle and may include any combination of water, detergent, fabric softener, bleach, and other wash additives or treatments.

In addition, washing machine appliance 100 includes a wash basket 112 (FIGS. 2 and 3) that is positioned within tub 108 and generally defines a wash chamber 114 (FIGS. 2 and 3) including an opening 116 (FIGS. 2 and 3) for receipt of articles for washing. More specifically, wash basket 112 is rotatably mounted within tub 108 such that it is rotatable about an axis of rotation A (FIG. 3). According to the illustrated embodiment, the axis of rotation A is substantially parallel to the vertical direction V. In this regard, washing machine appliance 100 is generally referred to as a "vertical axis" or "top load" washing machine appliance 100. However, as noted above, it should be appreciated that aspects of the present subject matter may be used within the context of a horizontal axis or front load washing machine appliance as well.

Cabinet 102 of washing machine appliance 100 has a top panel 118. Top panel 118 defines an opening (FIG. 2) that coincides with opening 116 of wash basket 112 to permit a user access to wash basket 112. Washing machine appliance 100 further includes a door 120 that is rotatably mounted to top panel 118 to permit selective access to opening 116. In particular, door 120 selectively rotates between the closed position (FIGS. 1 and 3) and the open position (FIG. 2). In the closed position, door 120 inhibits access to wash basket 112. Conversely, in the open position, a user can access wash basket 112. A window 122 (FIGS. 1 and 2) in door 120 permits viewing of wash basket 112 when door 120 is in the closed position, e.g., during operation of washing machine appliance 100. Door 120 also includes a handle 124 (FIGS. 1 and 2) that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Washing machine appliance 100 further includes a pump assembly 130 (FIG. 3) that is located beneath tub 108 and wash basket 112 along the vertical direction V for gravity assisted flow when draining tub 108, e.g., after a wash or rinse cycle. Pump assembly 130 includes a drain pump 132 mounted to tub 108. Drain pump 132 is operable to facilitate drainage of wash fluid from tub 108. As shown, drain pump 132 is fluidly connected with tub 108 and wash fluid can exit drain pump 132 and exit washing machine appliance 100 via an exit conduit 136.

An impeller or agitation element 140 (FIG. 3), such as a vane agitator, impeller, auger, oscillatory basket mechanism, or some combination thereof is disposed in wash basket 112 to impart an oscillatory motion to articles and liquid in wash basket 112. More specifically, agitation element 140 extends into wash basket and assists agitation of articles disposed within wash basket 112 during operation of washing machine appliance 100, e.g., to facilitate improved cleaning. In different embodiments, agitation element 140 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 140 and wash basket 112 are oriented to rotate about the axis of rotation A (which is parallel or substantially parallel to vertical direction V). Washing machine appliance 100 further includes a drive assembly 142 in mechanical communication with wash basket 112 to selectively rotate wash basket 112 (e.g., during an agitation or a rinse cycle of washing machine appliance 100). In addition, drive assembly 142 may also be in mechanical communication with agitation element 140. In this manner, drive assembly 142 may be configured for selectively rotating or oscillating wash basket 112 and/or agitation element 140 during various operating cycles of washing machine appliance 100.

Referring now to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation. Operation of washing machine appliance 100 is controlled by a controller or processing device 156 that is communicatively coupled with control panel 150 for user manipulation to select washing machine cycles and features. In response to user manipulation of control panel 150, controller 156 operates the various components of washing machine appliance 100 to execute selected machine cycles and features. Controller 156 can include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 can be in communication with controller 156 via one or more signal lines or shared communication busses. During operation of washing machine appliance 100, laundry items are loaded into wash basket 112 through opening 116, and washing operation is initiated through operator manipulation of input selectors 152. Wash basket 112 is filled with water and detergent and/or other fluid additives via primary dispenser 110. One or more valves can be controlled by washing machine appliance 100 to provide for filling tub 108 and wash basket 112 to the appropriate level for the amount of articles being washed and/or rinsed. By way of example, for a wash mode, once wash basket 112 is filled with fluid to the appropriate level, the contents of wash basket 112 can be agitated (e.g., with agitation element 140 as discussed previously) for washing of laundry items in wash basket 112.

More specifically, referring specifically now to FIG. 3, a water fill process will be described according to an example embodiment. As illustrated, washing machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, washing machine appliance 100 includes a water fill valve or water control valve 166 that is fluidly coupled with water supply conduit 160 and communicatively coupled to controller 156. In this manner, controller 156 may regulate the operation of water control valve 166 to regulate the amount of water within tub 108. In addition, washing machine appliance 100 can include one or more pressure sensors for detecting the amount of water and or clothes within tub 108. For example, a pressure sensor can be operably coupled to a side of tub 108 for detecting the weight of tub 108.

After tub 108 is filled and the agitation phase of the wash cycle is completed, wash basket 112 can be drained, e.g., by drain pump assembly 130. Laundry articles can then be rinsed by again adding fluid to wash basket 112 depending on the specifics of the cleaning cycle selected by a user. The impeller or agitation element 140 may again provide agitation within wash basket 112. One or more spin cycles may also be used as part of the cleaning process. In particular, a spin cycle may be applied after the wash cycle and/or after the rinse cycle in order to wring wash fluid from the articles being washed. During a spin cycle, wash basket 112 is rotated at relatively high speeds to help wring fluid from the laundry articles through perforations 126. After articles disposed in wash basket 112 are cleaned and/or washed, the user can remove the articles from wash basket 112, e.g., by reaching into wash basket 112 through opening 116. The wash fluid wrung from the articles can once again be drained via drain pump assembly 130.

In some instances, sand and other debris can be washed or wrung from the articles within wash basket 112 and drained from wash tub 108 via drain pump assembly 130. In accordance with example aspects of the present disclosure, drain pump 132 can include features for preventing sand and other debris from becoming lodged or stuck within the pump. In this way, better pump performance and flow rates can be maintained and the pump is less susceptible to becoming clogged or inoperable, particularly on startup of the pump. An example pump is provided below.

Figure 4:
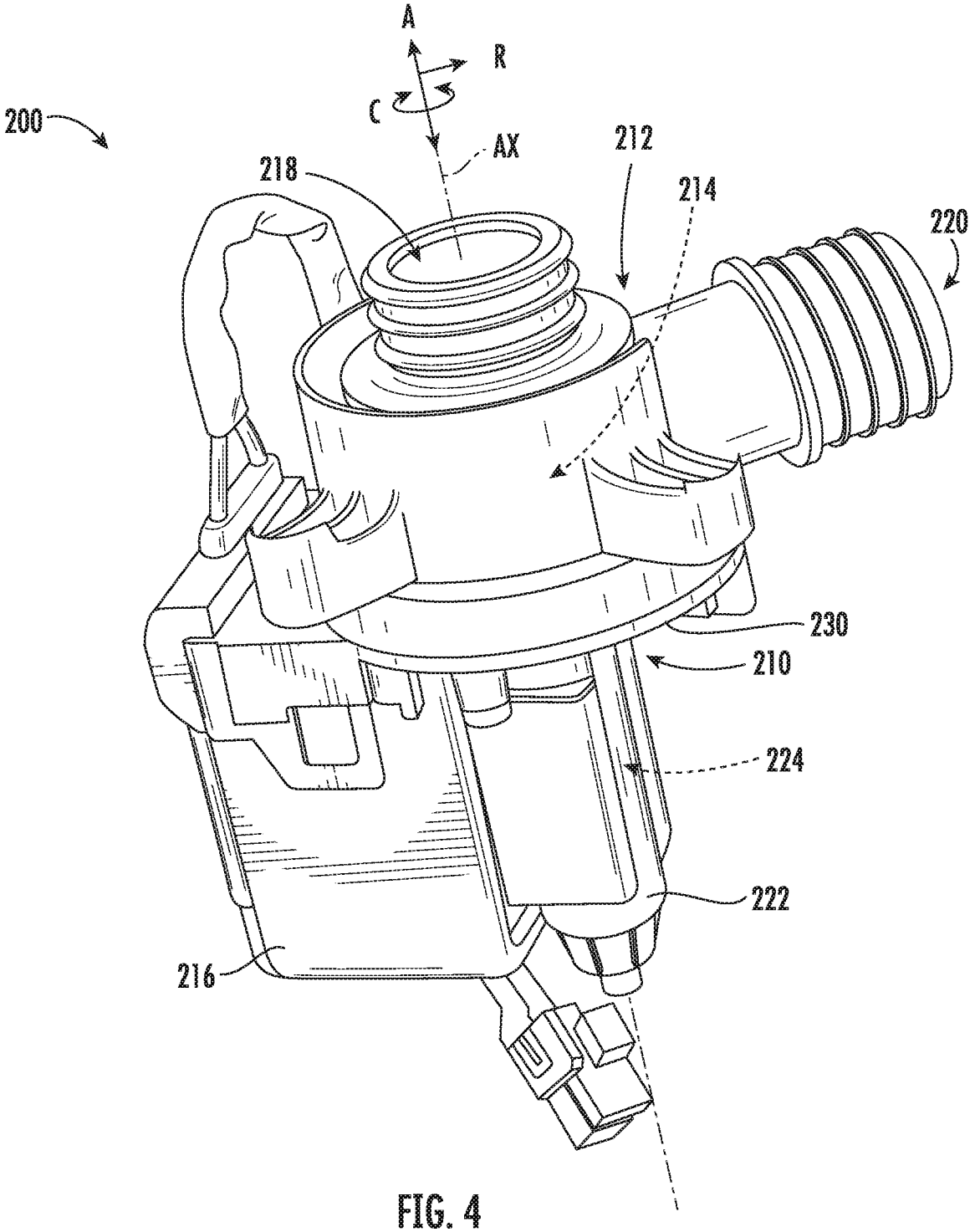
FIG. 4 provides a perspective view of an example pump according to an example embodiment of the present subject matter.

FIG. 4 provides a perspective view of a pump 200 according to an example embodiment of the present subject matter. Pump 200 can be the drain pump 132 of washing machine appliance 100 of FIGS. 1 through 3, for example. For reference, pump 200 defines an axial direction A, a radial direction R, a circumferential direction C, and an axis of rotation AX extending along the axial direction A. The circumferential direction C extends three hundred sixty degrees (360°) around the axis of rotation AX and the radial direction R extends to and from the axis of rotation AX in a plane orthogonal to the axial direction A. In addition, for this embodiment, the axial direction A corresponds with the vertical direction V (FIG. 3). Accordingly, the axis of rotation AX extends along the vertical direction V. Thus, for this embodiment, pump 200 is a vertically mounted pump as the impeller of pump 200 is rotatable about the vertical direction V and is positioned vertically above the pump body of pump 200 as will be explained in further detail below.

Figure 5:
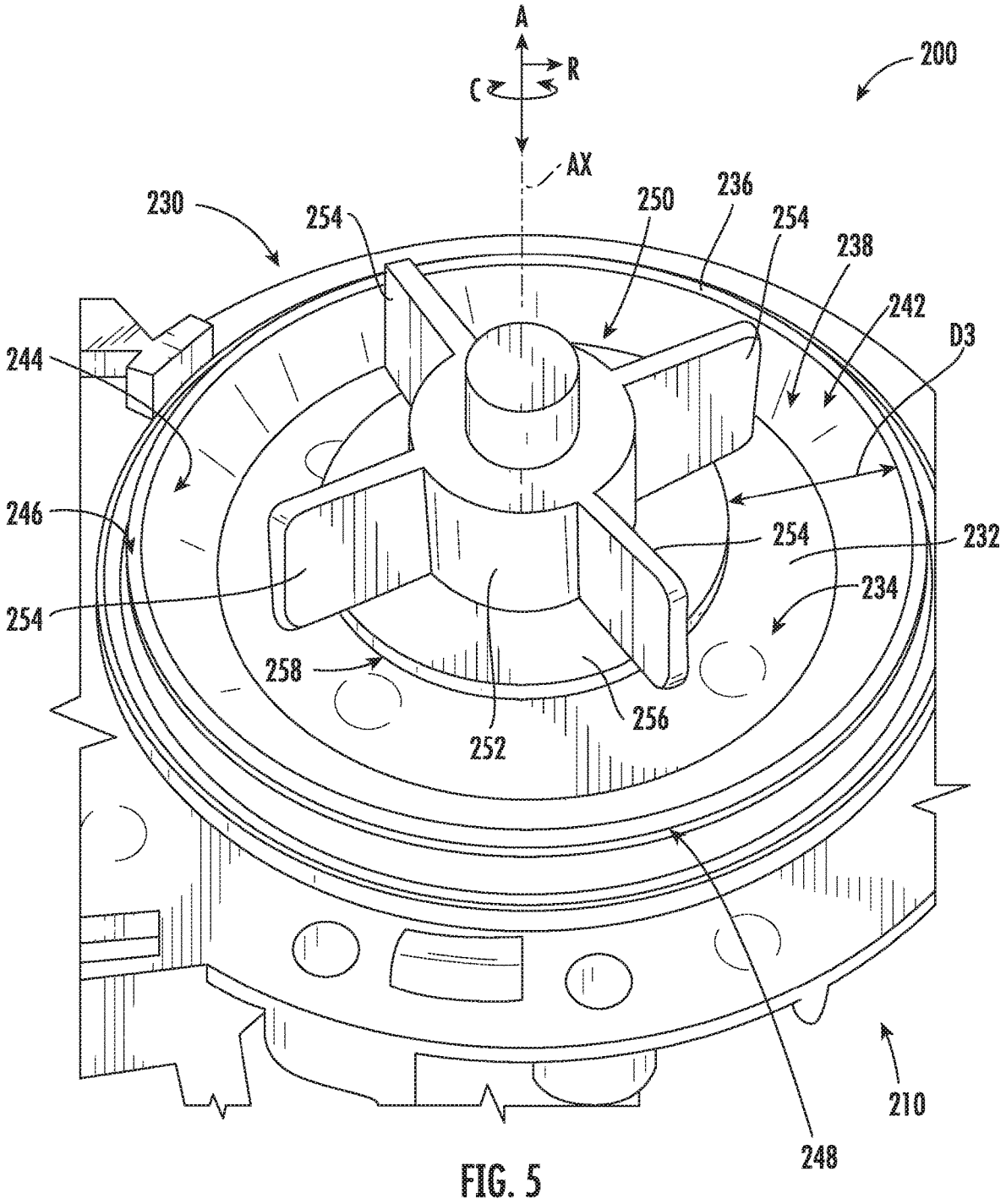
FIG. 5 provides a perspective view of the pump of FIG. 4 with a pump housing of the pump removed.
Figure 6:
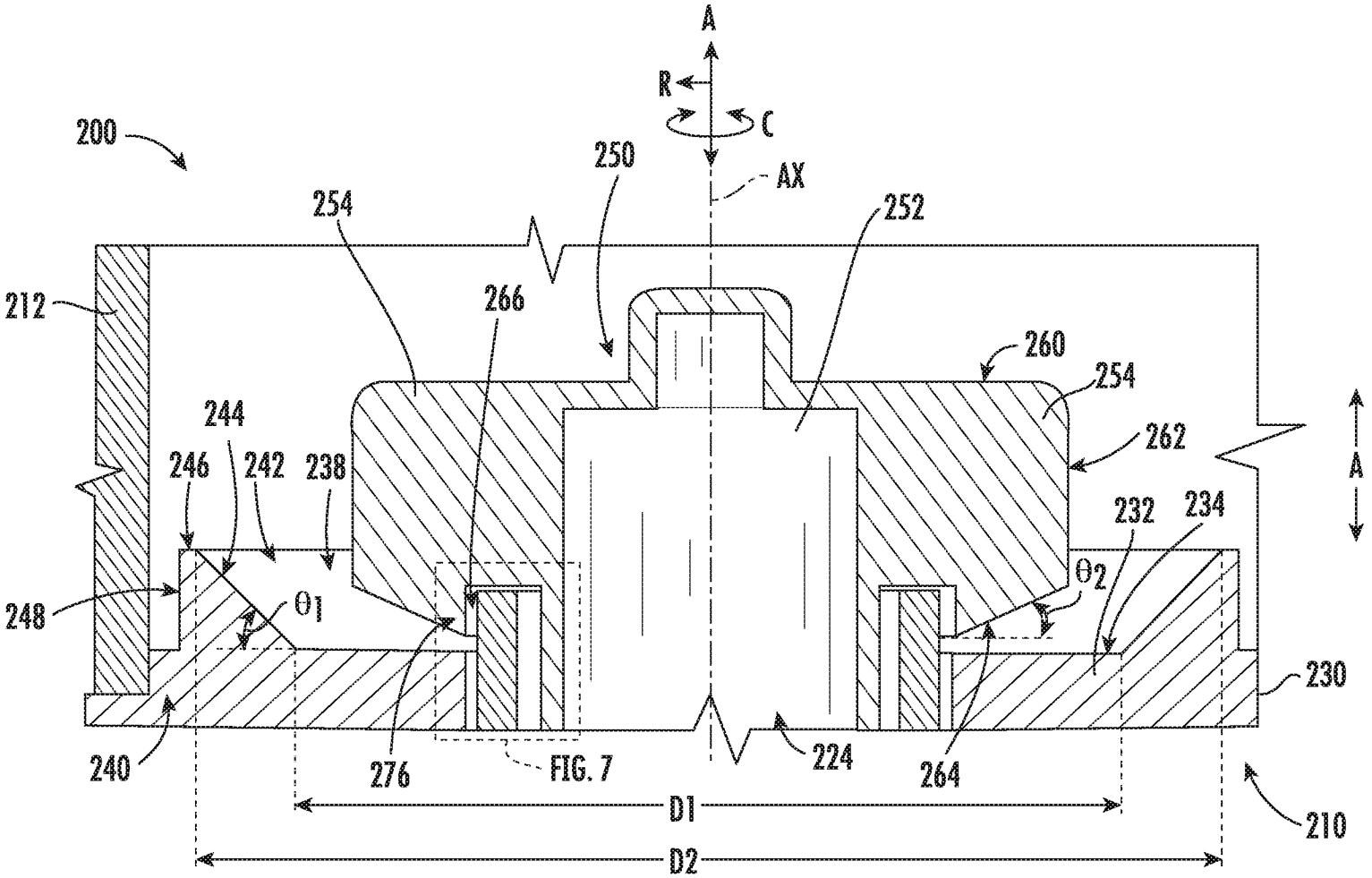
FIG. 6 provides a cross-sectional view of the pump of FIG. 4.

As shown in FIG. 4, pump 200 includes a pump body 210 and a pump housing 212 mounted to the pump body 210, e.g., via one or more mechanical fasteners. Pump body 210 at least partially defines a pump chamber 214 and pump housing 212 also at least partially defines pump chamber 214. Thus, collectively, pump body 210 and pump housing 212 define pump chamber 214. A pump motor 216 can be mounted to or encased within pump body 210. Pump motor 216 is operable to drive various rotatable components (e.g., an impeller) about the axis of rotation AX, e.g., based on command signals from controller 156 of washing machine appliance 100 (FIGS. 1 through 3). Pump body 210 has a base 230 and a stem 222. Stem 222 of pump body 210 defines a well 224 or hollow chamber for housing various components, e.g., sealing components for containing fluid and transmission components for transmitting mechanical energy to rotatable components positioned within pump chamber 214. Pump housing 212 defines a pump inlet 218 and a pump outlet 220. Pump inlet 218 provides an ingress for pump 200 to receive fluid, e.g., wash fluid from tub 108 (FIG. 3), and pump outlet 220 provides an egress for fluid energized by pump 200 to exit pump 200, e.g., via exit conduit 136 (FIG. 3). FIGS. 5 and 6 provide further views of pump 200. Particularly, FIG. 5 provides a perspective view of pump 200 with pump housing 212 removed for illustrative purposes and FIG. 6 provides a cross-sectional view of pump 200. As depicted, pump 200 includes an impeller 250 positioned within pump chamber 214 (FIG. 4) and rotatable about the axis of rotation AX. For instance, impeller 250 can be driven by various transmission elements mechanically coupling impeller 250 with pump motor 216 (FIG. 4). Impeller 250 can be a bi-directional impeller, and thus, impeller 250 can rotate about the axis of rotation AX in multiple directions, e.g., in a clockwise and a counter-clockwise direction. Impeller 250 has a shaft 252 extending longitudinally along the axial direction A. Shaft 252 is positioned within the well 224 of pump body 210 and extends at least partially into pump chamber 214. Impeller 250 has a plurality of blades 254 each extending outward from shaft 252 along the radial direction R. Blades 254 are spaced from one another along the circumferential direction C. As shown best in FIG. 5, impeller 250 also has a disk 256 connecting adjacent blades of the plurality of blades 254. Disk 256 is generally circular and extends outward from shaft 252 along the radial direction R and in a plane orthogonal to the axial direction A. For this embodiment, blades 254 of impeller 250 extend further outward from shaft 252 than disk 256 along the radial direction R. Disk 256 and blades 254 are positioned vertically above pump body 210.

Base 230 of pump body 210 has a base wall 232 having a base surface 234 that extends in a plane orthogonal to the axial direction A. Base 230 also has an outer rim 236 that extends from base wall 232 along the axial direction A. Specifically, outer rim 236 extends from base surface 234 of base wall 232 upward along the axial direction A such that base wall 232 and outer rim 236 define a pump body recess 238. Thus, together, base wall 232 and outer rim 236 collectively form a bowl-like shape. Moreover, for this embodiment, outer rim 236 extends entirely around impeller 250 along the circumferential direction C at or near a circumference 240 (FIG. 6) of base 230.

Outer rim 236 has a sloped face 244 that faces radially inward toward the axis of rotation AX, an outer face 248 that faces radially outward away from the axis of rotation AX, and a top face 246 connecting sloped face 244 and outer face 248. For this embodiment, outer face 248 extends in a plane along the axial direction A and along the circumferential direction C. Top face 246 extends in a plane orthogonal to the axial direction A and along the circumferential direction C. Top face 246 of outer rim 236 defines a recess opening 242 to pump body recess 238. Notably, recess opening 242 of pump body recess 238 is greater in area than base surface 234 of base wall 232. Stated another way, base surface 234 of base wall 232 has a diameter D1 (FIG. 6) and top face 246 of outer rim 236 has a diameter D2 (FIG. 6), and wherein the diameter D2 of the top face 246 is greater than the diameter D1 of base surface 234 of base wall 232. This is due to the sloped or inclined surface of sloped face 244 of outer rim 236. Particularly, as shown, sloped face 244 is sloped such that the radially inner edge of top face 246 is radially outward of the radially outer edge of base surface 234 of base wall 232 with respect to the axis of rotation AX and the top face 246 is positioned vertically/axially above the base surface 234. In this way, sloped face 244 of outer rim 236 provides a sloped surface for sand and other debris to flush off from beneath impeller 250 during operation. This facilitates removal of sand and debris from pump 200 and prevents sand and debris from collecting under impeller 250, and particularly under disk 256 of impeller 250. Thus, pump 200 is less susceptible to clogs and degradation of pump performance caused by sand and other debris.

For this embodiment, sloped face 244 of outer rim 236 is sloped by about forty-five degrees (45°) with respect to a direction orthogonal to the axial direction A, e.g., as shown by the angle $\theta_1$ in FIG. 6. However, other angles are possible. For instance, in some embodiments, sloped face 244 of outer rim 236 is sloped by about thirty degrees (30°) with respect to a direction orthogonal to the axial direction A. Preferably, sloped face 244 of outer rim 236 is sloped by less than about sixty degrees (60°) with respect to a direction orthogonal to the axial direction A. Moreover, for this embodiment, sloped face 244 of outer rim 236 connects base wall 232 with top face 246 of outer rim 236. That is, sloped face 244 connects base surface 234 of base wall 232 with top face 246. This facilitates the flushing out of sand and debris from pump body recess 238.

In addition, to further facilitate the flushing of sand and debris from pump body recess 238 during operation of pump 200, or more particularly from beneath impeller 250, disk 256 has an open disk design. More specifically, for this embodiment, an outer edge 258 of disk 256 is spaced from top face 246 of outer rim 236 a distance D3 (FIG. 5) along the radial direction R. Thus, sand and other debris may more easily exit or be flushed from pump body recess 238, e.g., compared to impellers having discs that extend to or very nearly to an outer rim of the base. In some embodiments, outer edge 258 of disk 256 is spaced from top face 246 of outer rim 236 by at least about 0.5 inches along the radial direction R. In yet other embodiments, outer edge 258 of disk 256 is spaced from top face 246 of outer rim 236 by about 0.5 inches along the radial direction R. In other embodiments, outer edge 258 of disk 256 is spaced from top face 246 of outer rim 236 between 0.5 and 0.6 inches along the radial direction R. Accordingly, while disk 256 does extend radially outward from shaft 252 in a plane orthogonal to the axial direction A, e.g., to increase the flow rate and performance of pump 200, disk 256 is spaced from outer rim 236 to provide an opening for sand and debris to escape or be flushed from pump body recess 238.

Referring now to FIG. 6, in some embodiments, if sand or other debris is moved beneath impeller 250 within pump body recess 238, the geometry of the blades 254 can facilitate removal of sand and debris from pump body recess 238. As depicted, each blade 254 has a top edge 260, a bottom edge 264, and a radially outer edge 262 connecting top edge 260 and bottom edge 264. The top edge 260 of each blade 254 extends generally longitudinally along the radial direction R and the radially outer edge 262 of each blade 254 extends generally longitudinally along the axial direction A. Notably, the bottom edge 264 of each blade 254 is angled with respect to a direction orthogonal to the axial direction A, e.g., as shown by the angle $\theta_2$ in FIG. 6. In some embodiments, for instance, the bottom edge 264 of each blade 254 is angled about twenty degrees (20°) with respect to a direction orthogonal to the axial direction A. In some embodiments, the bottom edge 264 of each blade 254 is angled between ten degrees (10°) and thirty degrees (30°) with respect to a direction orthogonal to the axial direction A. In other embodiments, the bottom edge 264 of each blade 254 is angled between fifteen degrees (15°) and twenty-five degrees (25°) with respect to a direction orthogonal to the axial direction A.

Figure 7:
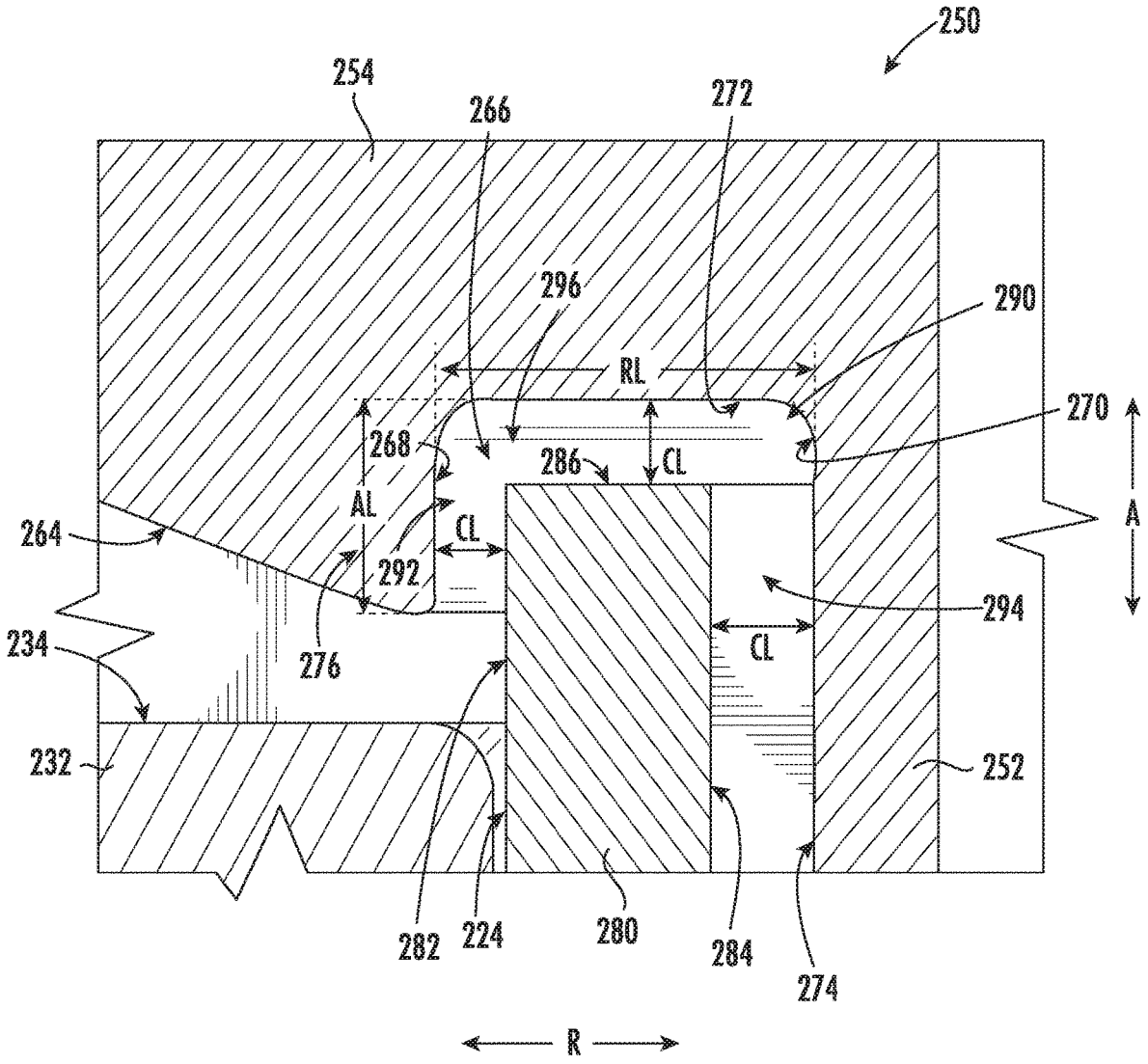
FIG. 7 provides a close up view of Section 7 of FIG. 6.

Referring generally now to FIGS. 6 and 7, additional features for management of sand and debris are provided. FIG. 7 provides a close up view of Section 7 of FIG. 6. As depicted, impeller 250 defines a cutout 266. Impeller 250 defines cutout 266 between bottom edge 264 of the blades 254 and shaft 252. Cutout 266 is generally rectangular and can extend annularly along the circumferential direction C. However, in other embodiments, cutout 266 can be other suitable shapes and/or need not extend annularly around the circumferential direction C. For this embodiment, cutout 266 has an outer surface 268, an inner surface 270 that is contiguous with an outer surface 274 of shaft 252, and a radial surface 272 that extends between and connects outer surface 268 with inner surface 270. Outer surface 268 has an axial length AL and radial surface 272 has a radial length RL.

Furthermore, as shown in FIGS. 6 and 7 pump 200 includes a retainer or seal 280 disposed around shaft 252 of impeller 250. Seal 280 has an outer surface 282, an inner surface 284, and a top surface 286 extending between and connecting the outer surface 282 and inner surface 284. Inner surface 284 of seal 280 is generally positioned adjacent outer surface 274 of shaft 252. A clearance CL is defined between inner surface 284 of seal 280 and outer surface 274 of shaft 252. The clearance can be 0.020 inches, for example. Notably, seal 280 is positioned at least partially in well 224 and at least partially within cutout 266 defined by impeller 250 such that the impeller 250 overhangs seal 280 along the axial direction A. Stated another way, impeller 250 is positioned on both the radially inner side of seal 280 and the radially outer side of seal 280. As shown in FIG. 7, impeller 250 has an overhanging portion 276. In some embodiments, cutout 266 has an axial length AL of at least 0.080 inches. In other embodiments, cutout 266 has an axial length AL of about 0.085 inches. In this way, cutout 266 can accommodate a portion of seal 280 therein and create a more tortuous path as will be explained further below. In addition, as shown in FIG. 7, seal 280 extends into cutout 266 such that seal 280 extends more than half the axial length AL of cutout 266.

A labyrinth 290 is defined between impeller 250 and seal 280 at cutout 266. Labyrinth 290 provides a tortuous path to help prevent sand and other debris from becoming lodged or wedged between inner surface 284 of seal 280 and outer surface 274 of shaft 252. Labyrinth 290 has a radially outer axial passage 292 defined between impeller 250 and outer surface 282 of the seal 280. Labyrinth 290 also has a radially inner axial passage 294 defined between impeller 250 and inner surface 284 of seal 280. Further, labyrinth 290 has a radial passage 296 connecting the radially outer axial passage 292 and radially inner axial passage 294. Radial passage 296 is defined between impeller 250 and top surface 286 of seal 280. Radially outer axial passage 292 and radially inner axial passage 294 both extend longitudinally along the axial direction A (as well as annularly along the circumferential direction C) and the radial passage 296 extends longitudinally along the radial direction R (as well as annularly along the circumferential direction C). Accordingly, for a sand or debris particle to enter the gap between inner surface 284 of seal 280 and outer surface 274 of shaft 252, the particle must flow underneath impeller 250 within pump body recess 238 and turn ninety degrees (90°) to travel upward along the axial direction A through radially outer axial passage 292 due to overhanging portion 276 of impeller 250 overhanging seal 280. The particle must then turn ninety degrees (90°) and travel inward along the radial direction R through radial passage 296. Thereafter, the particle must turn ninety degrees (90°) once again to travel downward along the axial direction A through radially inner axial passage 294. This tortuous path greatly reduces or eliminates particles from traveling into the area defined between inner surface 284 of seal 280 and outer surface 274 of shaft 252.

In some embodiments, a minimum clearance CL of about 0.020 inches is maintained between impeller 250 and seal 280 along labyrinth 290. That is, for radially outer axial passage 292, a clearance CL of about 0.020 inches is maintained between outer surface 268 of cutout 266 and outer surface 282 of seal 280. Moreover, for radial passage 296, a clearance CL of about 0.020 inches is maintained between radial surface 272 of cutout 266 and top surface 286 of seal 280. In addition, for radially inner axial passage 294, a clearance CL of about 0.020 inches is maintained between inner surface 270 of cutout 266 and inner surface 284 of seal 280. Further, in some embodiments, cutout 266 has a radial length RL of at least 0.150 inches. In this way, cutout 266 can accommodate seal 280 and provide the desired clearance between seal 280 and impeller 250.

Figure 8:
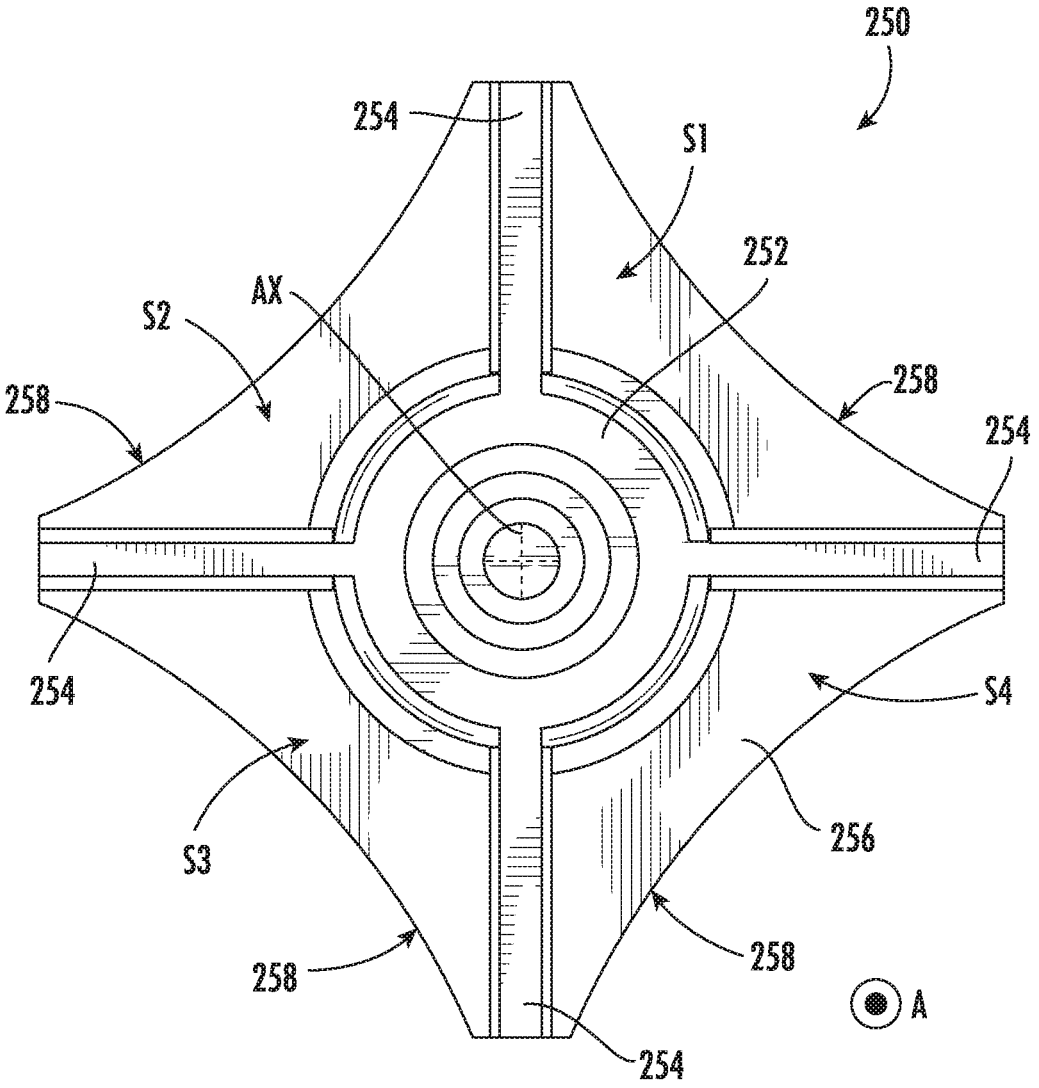
FIG. 8 provides a top view of an example impeller for a pump according to an example embodiment of the present subject matter.

FIG. 8 provides a top view of an example impeller 250 for a drain pump according to an example embodiment of the present subject matter. For instance, impeller 250 of FIG. 8 can be utilized in drain pump 132 of FIG. 3 or in pump 200 provided herein. As shown in FIG. 8, disk 256 defines a plurality of sections, including a first section S1, a second section S2, a third section S3, and a fourth section S4. Each section S1, S2, S3, S4 connects adjacent blades of the plurality of blades 254. Notably, each section S1, S2, S3, S4 of disk 256 has a convex outer edge 258 with respect to the axis of rotation AX (into and out of the page in FIG. 8) as viewed from the axial direction A (a direction into and out of the page in FIG. 8). Thus, for the depicted embodiment of FIG. 8, impeller 250 has a non-circular disk with convex edges. The design and shape of convex outer edges 258 opens up disk 256 and facilitates the flushing out of sand and debris from pump body recess 238 (FIG. 6). Thus, a pump in which impeller 250 is employed may be less susceptible to clogs and degradation of pump performance caused by sand and other debris.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A pump for an appliance, the pump defining an axial direction, a radial direction, a circumferential direction, and an axis of rotation extending along the axial direction, the pump comprising:

a pump body at least partially defining a pump chamber, the pump body having a base with a base wall and an outer rim extending from the base wall along the axial direction, wherein the outer rim has a sloped face that slopes outward along the radial direction from the axis of rotation as the sloped face extends away from the base wall along the axial direction, and wherein the outer rim extends entirely around the impeller along the circumferential direction and the sloped face extends entirely around the outer rim along the circumferential direction, and wherein the sloped face of the outer rim annularly connects the base wall with a top face of the outer rim; and an impeller positioned within the pump chamber and rotatable about the axis of rotation.

2. The pump of claim 1, wherein the base wall and the outer rim define a pump body recess and the top face of the outer rim defines a recess opening to the pump body recess, and wherein the recess opening is greater in area than the base wall.

3. The pump of claim 1, wherein the base wall has a diameter and a top face of the outer rim has a diameter, and wherein the diameter of the top face is greater than the diameter of the base wall.

4. The pump of claim 1, wherein the outer rim is sloped by about forty-five degrees(45°) with respect to the axial direction.

5. The pump of claim 1, wherein the impeller has a shaft, a plurality of blades extending outward from the shaft along the radial direction and spaced from one another along the circumferential direction, and a disk connecting adjacent blades of the plurality of blades and extending outward from the shaft along the radial direction, and wherein the disk of the impeller is spaced from a top face of the outer rim by at least about 0.5 inches along the radial direction.

6. The pump of claim 5, wherein each of the plurality of blades of the impeller extend further outward from the shaft than the disk along the radial direction, and wherein the impeller is a bi-directional impeller.

7. The pump of claim 1, wherein the pump is a drain pump and the appliance is a washing machine appliance, and wherein the drain pump is vertically mounted to a tub of the washing machine appliance.

8. A washing machine appliance, comprising:

a cabinet;

a tub positioned within the cabinet;

a basket rotatably mounted within the tub, the basket defining a wash chamber for receipt of articles for washing; and a drain pump fluidly connected with the tub and operable to drain wash fluid from the tub, the drain pump defining an axial direction, a radial direction, a circumferential direction, and an axis of rotation extending along the axial direction, the drain pump comprising:

a pump body at least partially defining a pump chamber and a well, the pump body having a base with a base wall and an outer rim extending from the base wall along the axial direction, the outer rim having a sloped face that connects the base wall with a top face of the outer rim, and wherein the sloped face slopes outward along the radial direction from the axis of rotation as the sloped face extends away from the base wall along the axial direction;

an impeller positioned within the pump chamber and rotatable about the axis of rotation, the impeller having a shaft positioned within the well, a plurality of blades extending outward from the shaft along the radial direction and spaced from one another along the circumferential direction, and a disk connecting adjacent blades of the plurality of blades and extending outward from the shaft along the radial direction, wherein the impeller defines a cutout and the disk is spaced from the top face of the outer rim along the radial direction; and a seal disposed around the shaft of the impeller and positioned at least partially in the well and at least partially within the cutout defined by the impeller such that the impeller overhangs the seal.

* * * * *